United States Patent [19]

Wiczer

[11] 4,362,300

[45] Dec. 7, 1982

[54] CAP FOR PINBALL GAME REBOUND DEVICE

[75] Inventor: Max Wiczer, Skokie, Ill.

[73] Assignee: Wico Corporation, Niles, Ill.

[21] Appl. No.: 207,681

[22] Filed: Nov. 17, 1980

[51] Int. Cl.[3] ..... A63F 7/10

[52] U.S. Cl. ..... 273/119 A; 273/129 P

[58] Field of Search ..... 273/119 A, 118 D, 120 A, 273/121 A, 122 A, 123 A, 124 A, 125 A, 126 A, 129 S, 127 R, 129 P

[56] References Cited

U.S. PATENT DOCUMENTS

| | | | |
|---|---|---|---|
| 1,387,217 | 8/1921 | Watters | 40/622 X |
| 2,311,447 | 2/1943 | Koci | 273/118 A X |
| 4,073,612 | 2/1978 | Nitta | 40/622 X |
| 4,097,047 | 6/1978 | Ochi | 273/127 R |

OTHER PUBLICATIONS

"Wico Corporation", Drawing No. 15-0780, Nov. 26, 1979.

*Primary Examiner*—George J. Marlo

*Attorney, Agent, or Firm*—Dithmar, Stotland, Stratman & Levy

[57] ABSTRACT

An automatic rebound device for a pinball game has a cylindrical pedestal portion which projects above the playfield board and carries an electric lamp therein, the pedestal having an annular attachment flange at its upper end with vertical openings therein at diametrically opposed points thereon. A hollow circular cap has a cylindrical side wall and two connecting pins projecting beyond the distal edge of the cylindrical side wall for press-fitting engagement in the pedestal openings. The side wall is dimensioned for cooperation with the pedestal to provide a chamber for the electric lamp of sufficient volume to prevent overheating of the cap.

7 Claims, 4 Drawing Figures

FIG. 1
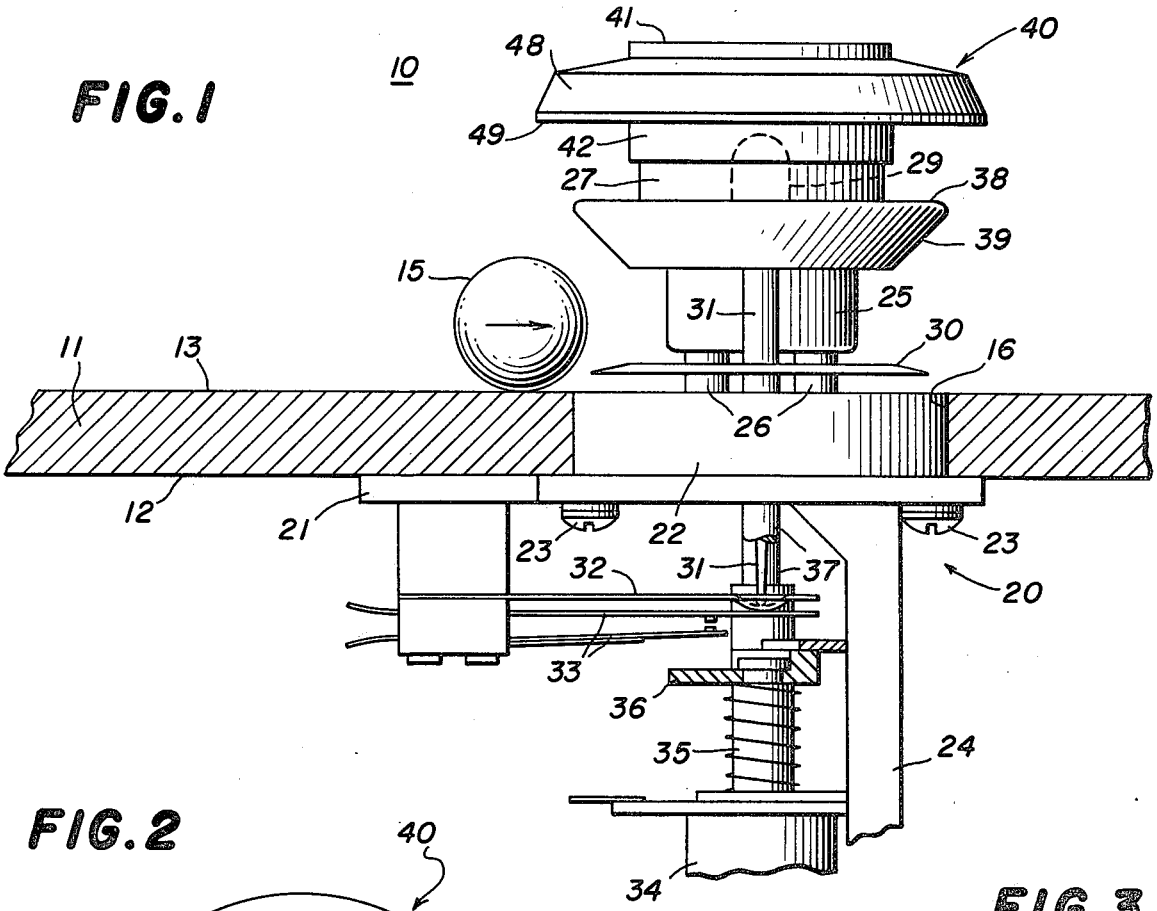
FIG. 2
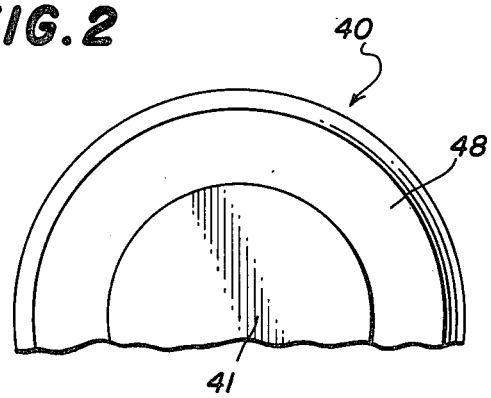
FIG. 3
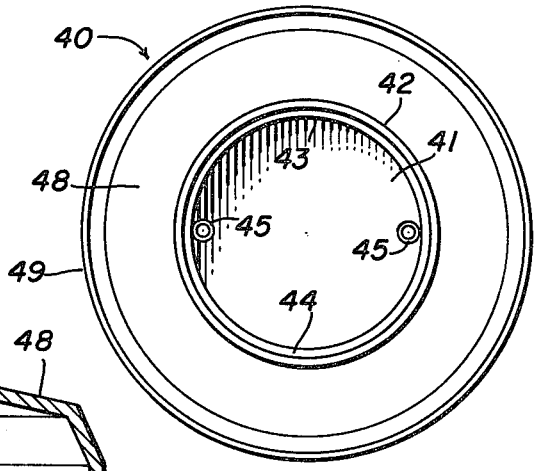
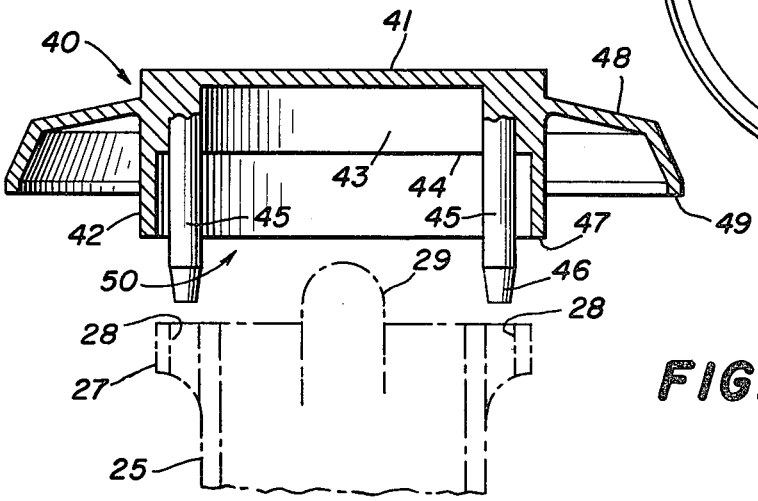
FIG. 4

CAP FOR PINBALL GAME REBOUND DEVICE

BACKGROUND OF THE INVENTION

The present invention relates to an automatic rebound device for a pinball game and, more specifically, to an improved cap for such a device. Such automatic rebound devices typically have a pedestal portion which extends above the playfield board and forms a socket for an electric lamp bulb which is lit when the device is struck by a rolling pinball. A cap mounted on the pedestal portion conceals the lamp bulb and provides a decorative top for the device. The cap is typically formed of a translucent plastic through which the light from the electric lamp can be seen.

The caps in prior art devices are typically fastened to the pedestal portion by screws extending downwardly through the top of the cap. These screws detract from the appearance of the device and, furthermore, complicate the assembly and disassembly of the cap. Thus, in order to change the lamp bulb, for example, the cap must be removed by the use of a screwdriver and the removal of two or more screws.

Additionally, the caps of prior art devices have fit closely against the pedestal portion and the lamp bulb therein and have provided insufficient space beneath the cap for dissipating the heat of the lamp, resulting in overheating of the assembly and possible scorching of plastic parts.

SUMMARY OF THE INVENTION

It is a general object of the present invention to provide an improved cap assembly for a pinball game automatic rebound device which avoids disadvantages of prior art devices.

It is an important feature of this invention that there is provided an automatic rebound device which is characterized by a cap of simple and economical construction which can readily and easily be attached and detached without the use of tools.

It is another object of this invention to provide and automatic rebound device, wherein the cap is so constructed and assembled on the device as to provide for the associated lamp a chamber of sufficient size to insure efficient heat dissipation.

These and other objects of the invention are attained by providing in an automatic rebound device mounted on the playfield board of a pinball game and having a pedestal portion projecting above the playfield board and carrying an electric lamp therein, the improvement comprising an opening formed in the top of the pedestal portion, a hollow cap having a mounting pin extending therefrom, the pin being adapted for press-fitting in the opening for mounting the cap in an assembled position covering the pedestal portion and the electric lamp therein, the cap being dimensioned for cooperation with the pedestal portion to provide a chamber for the electric lamp of sufficient volume to prevent overheating of the cap.

The invention consists of these and other novel features in a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

FIG. 1 is a fragmentary side elevational view in partial section of an automatic rebound device for a pinball game, constructed in accordance with and embodying the features of the present invention;

FIG. 2 is a fragmentary top plan view of the cap of the automatic rebound device of FIG. 1;

FIG. 3 is a bottom plan view of the cap illustrated in FIG. 2; and

FIG. 4 is an enlarged view in vertical section of the cap of FIG. 2, illustrating the manner of mounting on the pedestal portion of the rebound device.

DESCRIPTION OF THE PREFERRED EMBODIMENT

Referring to FIG. 1 of the drawings, there is illustrated an automatic rebound device, generally designated by the numeral 10, for use in a pinball game. Such automatic rebound devices 10 are commonly known as "thumper bumpers", and they operate to impart an accelerating force to a pinball which rolls into engagement therewith. The rebound device 10 is mounted on the playfield board 11 of the pinball game, the playfield board 11 having a lower surface 12 and an upper surface 13 on which the associated pinball 15 rolls. More particularly, the rebound device 10 is mounted in a circular opening 16 in the playfield board 11.

The rebound device 10 includes a housing, generally designated by the numeral 20, which includes a flat platform 21 having a cylindrical bushing 22 extending upwardly therefrom. In use the bushing 22 snugly fits into the circular opening 16 in the playfield board 11, with the platform 21 disposed against the bottom surface 12 of the playfield board 11 and fixedly secured thereto by a plurality of screws 23. When thus assembled, the upper edge of the bushing 22 is substantially flush with the upper surface 13 of the playfield board 11. Integral with the platform 21 and extending downwardly therefrom is a bracket leg 24.

Mounted above the platform 21 is a generally cylindrical pedestal portion 25, supported a predetermined distance above the upper surface 13 of the playfield board 11 by a plurality of support legs 26 which are connected to the platform 21 inside the bushing 22. The pedestal portion 25 is provided at the upper end thereof with a radially outwardly extending attachment flange 27 provided with two cylindrical openings 28 extending vertically therethrough at diametrically spaced-apart points therealong (see FIG. 4). The pedestal 25 is generally in the form of a hollow cup-like member having an electrical socket (not shown) disposed therein in which is mounted an electric lamp bulb 29 which typically projects a predetermined distance above the upper end of the pedestal 25.

Disposed between the bushing 22 and the pedestal 25 and resiliently urged against the bottom of the latter by a suitable compression spring (not shown) is a circular tilt plate 30 having apertures therethrough for accommodating the pedestal support legs 26. Integral with the tilt plate 30 at the center thereof and projecting downwardly therefrom through an aperture in the platform 21 is a finger 31, the lower end of which contacts a depression in the free end of a flexible arm 32 mounted in cantilever fashion on the platform 21.

In operation, when a pinball 15 contacts the rebound device 10, it rolls up onto and depresses the adjacent side of the tilt plate 30, thereby depressing the finger 31 and flexible arm 32 for closing a pair of switch contacts 33, thereby lighting the lamp bulb 29 and energizing a solenoid 34 which is mounted on the bracket leg 24. A plunger 35 of the solenoid 34 has the upper end thereof connected to a yoke 36, which in turn is connected to the lower ends of two connecting rods 37. The connecting rods 37 extend upwardly through complementary openings in the platform 21 and the tilt plate 30 and are connected at their upper ends to an annular thrust ring 38 having a downwardly and radially inwardly sloping beveled surface 39. When the solenoid 34 is energized, its plunger 35 retracts, pulling the thrust ring 38 downwardly, bringing its beveled surface 39 into sudden forceful engagement with the pinball 15, thereby driving it outwardly away from the rebound device 10 with a camming-type action. Thus, the pinball 15 is accelerated by the rebound device 10 so that it rebounds therefrom at a relatively high velocity, regardless of the impact velocity.

Referring now also to FIGS. 2 through 4 of the drawings, the rebound device 10 is provided with a cap, generally designated by the numeral 40, which has a substantially flat circular top wall 41 provided with a cylindrical side wall 42 extending downwardly therefrom around the entire perimeter thereof to form a hollow inverted cup-like structure. The cylindrical side wall 42 has a radially inwardly thickened portion 43 at the inner end thereof which extends axially about half of the length of the cylindrical side wall 42 and defines at the outer end thereof an annular shoulder 44.

Integral with the top wall 41 at diametrically spaced-apart points thereon and projecting therefrom in the same direction as the cylindrical side wall 42 parallel to the longitudinal axis thereof and substantially tangent to the thickened portion 43 thereof are two cylindrical mounting posts or pins 45. The distal ends of the pins 45 are tapered, as at 46, and project outwardly a predetermined distance beyond the distal end 47 of the cylindrical side wall 42. Integral with the cylindrical side wall 42 and projecting radially outwardly therefrom adjacent to the top wall 41 is an annular skirt flange 48 which terminates at a distal edge 49 spaced a predetermined distance above the distal edge 47 of the cylindrical side wall 42. The skirt flange 48 has an upper nearly-horizontal portion and a lower nearly-vertical portion which are disposed at an obtuse angle to each other.

In use, the cap 40 is mounted on the pedestal portion 25 by inserting the tapered ends 46 of the pins 45 respectively into the upper ends of the openings 28 in the pedestal attachment flange 27. The main body of each of the pins 45 has a diameter substantially the same as that of the associated opening 28, to afford a snug press-type fit therein. Preferably, the pins 45 are inserted into the openings 28 until the distal end 47 of the cylindrical side wall 42 is substantially flush with the upper edge of the pedestal attachment flange 27, thereby to conceal the lamp bulb 29 from the view of a user of the pinball game. It will, however, be appreciated that the cap 40 is preferably formed of a transparent or translucent material such as plastic or the like so that the light from the lamp 29 can shine therethrough and so that it will be readily apparent to a user when the lamp bulb 29 has been lit.

The length of the cylindrical side wall 42 is such that when it is mounted in the fully assembled position, illustrated in FIG. 1, there is a considerable space between the lamp bulb 29 and the top wall 41 of the cap 40. Also, the diameter of the cylindrical side wall 42 of the cap 40 is preferably at least as great as the inner diameter of the pedestal portion 25. Thus, it will be appreciated that when the cap 40 is mounted in its assembled position illustrated in FIG. 1, it cooperates with the pedestal portion 25 to form a generally cylindrical chamber 50 for the lamp bulb 29, the volume of this chamber 50 being sufficient to insure efficient dissipation of the heat generated by the lamp bulb 29. The spacing of the parts of the cap 40 from the lamp bulb 29 is sufficient to effectively prevent scorching or discoloration thereof by the heat from the lamp bulb 29.

When it is desired to remove the cap 40, it can simply be pulled from the pedestal portion 25 without the use of any tools and it can then be reattached in the same manner as described above.

From the foregoing, it can be seen that there has been provided an improved cap assembly for an automatic rebound device of a pinball game, which cap assembly is of simple and economical construction and can readily be attached and detached to the associated pedestal portion without the use of tools. There has also been provided an improved cap assembly of the character described, which cooperates with the pedestal portion for providing a chamber for the lamp bulb of adequate volume to insure efficient dissipation of the heat generated by the lamp bulb.

What is claimed is:

1. In an automatic rebound device mounted on the playfield board of a pinball game and having a pedestal portion projecting above the playfield board and carrying an electric lamp therein, the improvement comprising an opening formed in the top of the pedestal portion, a cap having a cylindrical side wall shaped and dimensioned to permit overlapping with the pedestal portion and a top wall closing the upper end of said side wall, said cap including a flange extending laterally outwardly and downwardly from said side wall around the perimeter thereof and terminating well above the lower end of said side wall, an elongated mounting pin connected to said top wall of said cap and extending therefrom in the same direction as and well beyond the lower end of said side wall, said pin being adapted for press-fitting into said opening to a selected depth for mounting said cap in an assembled position covering the pedestal portion and the electric lamp therein, said cylindrical side wall of said cap being dimensioned for cooperation with the pedestal portion for substantially concealing the electric lamp and to provide a chamber for the electric lamp of sufficient volume to prevent overheating of the cap.

2. The device of claim 1, wherein said cylindrical side wall has a radially thickened portion adjacent to said top wall, said mounting pin extending along the inner surface of said thickened portion integral therewith parallel to the axis of said cylindrical side wall and being spaced from said cylindrical side wall at the distal end thereof.

3. The device of claim 1, wherein said pedestal portion has two openings formed in the top thereof, said cap including two mounting pins connected to the top wall thereof and respectively disposed for press-fitting into said openings.

4. The device of claim 1, wherein said pedestal portion and said cap are generally circularly cylindrical in shape.

5. The device of claim 1, wherein said flange includes a first portion inclined at a first predetermined angle with respect to the longitudinal axis of said cylindrical side wall and a second portion inclined at a second predetermined angle with respect to said axis.

6. The device of claim 1, wherein said pedestal portion has an annular attachment flange extending radially outwardly therefrom at the upper end thereof, said opening being disposed vertically in said attachment flange.

7. The device of claim 6, wherein said opening extends vertically through said attachment flange.

* * * * *